US006445299B1

(12) United States Patent
Rojas, Jr.

(10) Patent No.: US 6,445,299 B1
(45) Date of Patent: Sep. 3, 2002

(54) RETROFIT FOR PATIENT CALL SYSTEM AND METHOD THEREFOR

(76) Inventor: Antonio Rojas, Jr., 85 NE. 108th St., Miami Shores, FL (US) 33161-7035

( * ) Notice: Subject to any disclaimer, the term of this patent is extended or adjusted under 35 U.S.C. 154(b) by 0 days.

(21) Appl. No.: 09/771,732

(22) Filed: Jan. 29, 2001

(51) Int. Cl.[7] ..... G08B 23/00

(52) U.S. Cl. ..... 340/573.1; 340/539; 340/573.4; 128/903

(58) Field of Search ..... 340/293, 331, 340/539, 573.1, 573.4; 128/903, 904; 600/508, 591, 595

(56) References Cited

U.S. PATENT DOCUMENTS 4,455,548 A * 6/1984 Burnett ..... 340/293
4,665,385 A * 5/1987 Henderson ..... 340/539
4,835,372 A * 5/1989 Gombrich et al. ..... 235/375
5,564,429 A * 10/1996 Bornn et al. ..... 600/508
5,600,305 A 2/1997 Stafford et al. ..... 340/573.1
5,729,203 A * 3/1998 Oka et al. ..... 340/573.1
5,838,223 A 11/1998 Gallant et al. ..... 340/286.07
5,877,675 A 3/1999 Rebstock et al. ..... 340/286.07
5,963,137 A 10/1999 Waters, Sr. ..... 340/573.4
5,995,007 A 11/1999 Borja et al. ..... 340/573.4
6,160,478 A * 12/2000 Jacobsen et al. ..... 340/539

* cited by examiner

*Primary Examiner*—Van Trieu
(74) *Attorney, Agent, or Firm*—Robert C. Kain, Jr.; Fleit, Kain

(57) ABSTRACT

The retrofit patient call system retrofits onto the preexisting patient call system. The retrofit system includes a wireless patient call unit mounted on a patient using a wristband or strap and a wall unit retrofit mounted near the preexisting patient call system room port. The patient call unit allows the patient to activate a user actuated control coupled to a transmitter which generates a radio frequency (RF) patient call signal. The wall unit receives the RF patient call signal and produces a patient alarm signal which is sent via the preexisting room port and patient call system to a central monitoring station. The wall unit is programmed either to send the patient alarm signal in the same form as the preexisting hard-wired patient call switch or to activate the preexisting room port to generate the alarm. The wall unit may include a reset and a display for other valuable information.

44 Claims, 3 Drawing Sheets

RETROFIT FOR PATIENT CALL SYSTEM AND METHOD THEREFOR

The present invention relates to a wireless patient call system for retrofitting onto preexisting patient call systems.

BACKGROUND OF THE INVENTION

Most hospitals, nursing homes and other healthcare facilities utilize a hard-wired patient call system. Each patient room is wired with a patient-activated call switch. The call switch is usually an independent push-button or a patient-actuated control switch mounted on a small box together with other control switches (e.g. volume for a television, etc). The call switch is connected to a nearby room port via flexible electrical conductors. Each room is electronically connected to a central monitoring station, usually located at a nurse's station or other healthcare provider locale. Such patient call systems have serious limitations because a patient can only call for assistance if the patient is able to reach the patient call switch. If the patient's mobility is limited, a nurse or healthcare provider must position the call switch or push-button near the patient's hand. If the patient is mobile, or accidentally falls away from the general area of the patient call switch, the patient will not be able to activate the call switch unless he or she is able to reach for the switch. Many times the call switch will fall from the patient's hospital bed or just be out of the patient's reach. There is a need for a patient call system which does not require the patient to be physically linked to a room port. There is a need for a patient call system in which a patient can call for assistance by simply activating a wireless call switch located on the patient's person (preferably near the patient's hand). There is also a need for such a patient call system which can be retrofitted onto an existing patient call system thereby making it economically feasible for healthcare facilities to upgrade existing systems.

Although wireless patient call systems exist, the cost of replacing an existing hard-wired system for a new wireless system is either cost prohibitive or cannot be justified. Most patient call systems found in healthcare facilities were installed during construction or during a major renovation of the facility and include hardware embedded into the building's walls and difficult-to-reach locations. Accordingly, there is a need for a wireless patient call system which can be retrofitted onto a preexisting patient call system thereby eliminating the need to replace the entire system.

U.S. Pat. No. 5,600,305 to Stafford and Bock, discloses a portable patient monitoring system used to detect when a patient attempts to exit the hospital bed or the patient room. The system consists of a master unit with an infrared emitter and detector, and a portable external reflector which reflects an infrared beam from the emitter back to the detector. The system is set up so that if a patient crosses the infrared beam, a light on the master unit is activated as well as a switch to the nurses station.

U.S. Pat. No. 5,838,223 to Gallant, et al., discloses a patient/nurse call system with patient stations capable of generating hospital calls and a remote master station which prioritizes and stores calls. Hall units outside patient rooms identify the rooms from which the calls originate and the type of call. Nurse-worn badges transmit pulse-coded infrared signals which are received by receivers at the patient stations and in response, the systems generates identity and location signals which are stored at the master station. Receipt of a nurse's infrared signal at a room station automatically cancels a patient call originating from the room and actuates a display indicating a nurse's presence. By using the nurse call button, a patient can establish telephonic communication between the patient station and a wireless telephone being carried by the remotely located nurse.

U.S. Pat. No. 5,877,675 to Rebstock and Rast, discloses a portable, three-way wireless communication and locator system. The system provides a direct voice-communication link between a patient and the patient's care-giver, as well as to a central station. Each patient is equipped with a portable communication device which can be worn on the wrist. Each care-giver is also equipped with a portable communication device. The central station acts as a backup, in the event a care-giver cannot timely respond to a patient. The system works through a series of repeaters located throughout the facility. Each communication device contains identifying information. A particular patient is located by polling the communication device throughout the system and obtaining which repeater received the strongest signal.

U.S. Pat. No. 5,963,137 to Waters, discloses an audible, visual and remote alarm system designed to monitor the status of a person in another room to know when assistance may be needed. It is used primarily to monitor patients who may become mobile and may not be able to rationalize the need to summon help, such as Alzheimer patients, sleep walkers, etc. However, the system can also be used by individuals who can consciously summon assistance by activating a magnetic switch. The system utilizes a magnetic switch fastened to the patient. The opening of the magnetic switch completes the hard-wired circuitous path, thereby activating a visual alarm and an audio alarm.

U.S. Pat. No. 5,995,007 to Borja and Valdez, discloses a child proximity monitoring device. The device includes a wrist mounted portable module including a radio device. Also included is a monitoring unit also including a radio device and an indicator for indicating when the two radio devices have separated by a predetermined distance. During operation, the monitoring unit sends a continuous monitoring signal to the portable module. Upon receipt of the out-of-range signal, the monitoring unit sounds an alarm.

Objects of the Invention

It is an object of the present invention to provide a wireless patient call system which can be retrofit onto an existing hard-wired patient call system.

It a further object of the present invention to provide a patient with a patient call unit which the patient can wear on his or her wrist to enable that patient to summon the assistance of a healthcare provider.

It is another object of the present invention to provide a patient with a patient call unit which when activated by the patient sends a radio frequency signal to a wall unit retrofit mounted near the preexisting patient room port. The wall unit is retrofit onto the preexisting room port such that upon receipt of the radio frequency signal from the patient call unit, the wall unit sends a patient alarm signal substantially similar to the alarm signal sent by the preexisting hard-wired patient call unit to the preexisting central monitoring station.

SUMMARY OF THE INVENTION

The patient call system, in accordance with the principles of the present invention, is adapted to retrofit onto a preexisting patient call system. The patient call system, retrofit onto the preexisting system, consists of a patient call unit which is securely mounted on a patient using a wristband or strap and a wall unit retrofit mounted near the preexisting patient call system room port. The patient call unit allows the patient to activate a user actuated control electrically coupled to a transmitter which generates a radio frequency (RF) patient call signal. The wall unit, which is in communication with the RF transmitter in the patient call unit, receives the patient call signal and produces a patient alarm signal. The wall unit is electrically coupled to the preexisting room port and sends the patient alarm signal to the room port upon receipt of the patient call signal. The wall unit is programmed either to send the patient alarm signal in the same form as the preexisting hard-wired patient call switch or to activate the preexisting room port to generate the alarm. The patient alarm signal is then received by the preexisting central monitoring station in the same manner as if the alarm signal had been sent by the preexisting patient call switch. The retrofit patient call system includes a coupling interface with the preexisting patient call switch (such as a T coupler) to permit a healthcare facility to utilize both the present invention and the preexisting patient call switch (the switch at the end of the flexible cable or conductors). The patient call unit may include a fall detector electrically coupled to the transmitter. If the patient falls or the fall detector otherwise detects an abrupt jarring (a measurement of acceleration), the transmitter sends an RF patient call signal to the wall unit. The wall unit may include a display which displays information such as time elapsed since receipt of a patient call signal, the time of receipt of a patient call signal, programming information and power source information. The wall unit may also include a reset switch to reset the system after receipt of a patient call signal. The wall unit can be programmed to send multiple patient alarm signals at predetermined time intervals to the preexisting patient call system after receipt of a patient alarm signal from the patient call unit typically strapped to the patient's wrist.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a patient call system adapted to be retrofit onto an existing patient call system. The present invention provides a patient a wireless patient call unit with a user-actuated control to notify a healthcare provider that the patient needs assistance. The patient call unit sends a radio frequency (RF) signal to a wall unit retrofit mounted near a preexisting room port. Upon receiving the RF signal from the patient call unit, the wall unit sends a patient alarm signal to the room port in much the same manner that the preexisting, hard-wired patient call unit would.

Figure 1:
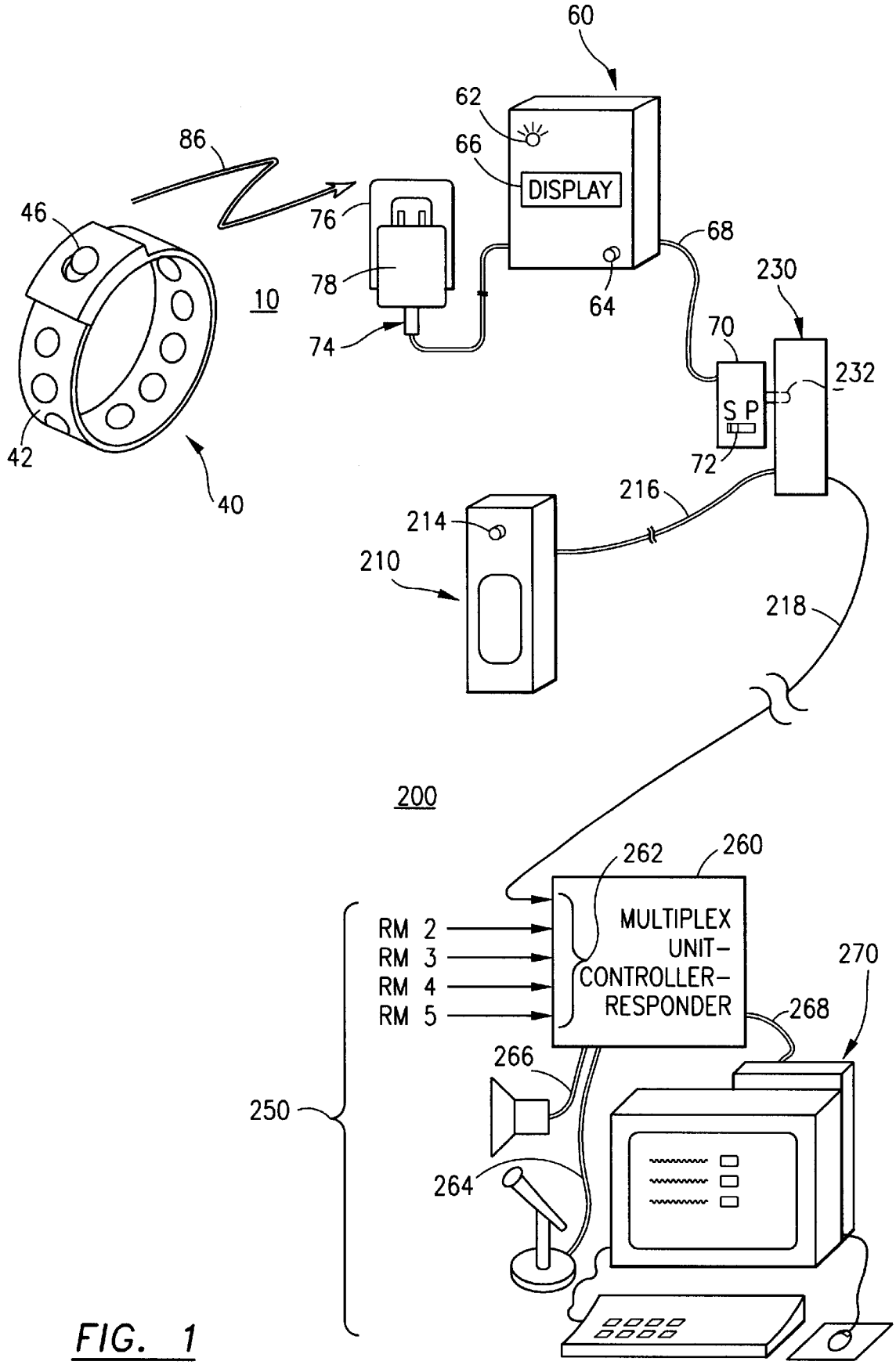
FIG. 1 diagrammatically illustrates the retrofit patient call system coupled to a preexisting patient call system.

FIG. 1 diagrammatically illustrates the patient call system 10 retrofit onto a preexisting patient call system 200. It is important to have an understanding of the preexisting patient call system to fully grasp the present invention and its advantages.

The preexisting patient call system 200 consists primarily of a patient-activated call switch 210, a patient room port 230, and a central monitoring station 250. The patient-activated call switch 210 includes a patient actuator or push-button 214 and is electrically coupled to room port 230 via an insulated, flexible conductor 216. Typically, conductor 216 includes several wires and is several feet in length. Hence, call switch 210 is "hard-wired" to room port 230. In some healthcare facilities the call switch box 210 may include additional "remote" controls such as volume control for a television set or may include a speaker to permit the patient to listen to radio or television programming.

Preexisting room port 230 is typically mounted near the patient's bed. Room port 230 includes jack 232 (depicted with dash lines in FIG. 1) which receives flexible conductor 216 and electrically couples call switch 210 to the rest of preexisting patient call system 200. Room port 230 is electronically coupled to the central monitoring station 250. The electronic coupling between room port 230 and central monitoring station 250 can be via wire conductors, fiber optics or any other medium permitting the exchange of information between the two (e.g. a local area network, wide area network, telecommunications system, etc.). For simplicity, the connection between room port 230 and central monitoring station 250 in FIG. 1 will be referred to as communication channel 218. Similar to call switch box 210, room port 230 may also include additional devices, such as an intercom link between the patient room and a nurses' station or emergency switches to page critical healthcare providers. Room port 230 may also be part of a modular unit which includes utilities normally found in hospital patient rooms and other healthcare facility patient rooms, such as a vacuum port or an emergency electrical power supply. Replacing a preexisting patient call system utilizing such multi-mode construction would be very costly and would require the room to be vacant for an extended period of time. The present invention avoids the high cost of replacing the entire patient call system, because the present invention can be installed in a patient room with little inconvenience to the patient or the hospital staff, and without disruption to the facility.

Each patient call switch 210 is linked via a respective hard-wired, flexible conductor 216, room port 230 and communications channel 218, to a central multiplex unit 260. The multiplexer 260 is an interface for central monitoring station 250. Multiplexer 260 contains many input and output ports, including input/output ports 262 for several patient rooms. The multiplexer also provides an interface for an audio input 264, audio output 266, and an input/output 268 for use with other electronic equipment such as a computer, monitor, keyboard and mouse (collectively, system 270).

The preexisting patient call system 200 functions as follows. A patient activates or enables patient call switch 210 through patient actuator or push-button 214. Call switch 210 is hard-wired to room port 230. The change in state of switch 214 results in the generation of a patient alarm signal. Call switch 210 is electrically coupled to room port 230 viahard-wire conductor 216. Room port 230 is electronically coupled to central monitoring station 250 via communications channel 218. Accordingly, the patient alarm signal travels from switch 210, is conditioned or modified by room port 230 and is sent via communications channel 218 to central monitoring station 250. The multiplexer 260 receives the patient alarm signal from the patient room and converts, modifies or conditions the signal into a form acceptable for use with associated electronic equipment, such as a computer or monitor display 270. A healthcare provider monitoring incoming alarm signals can then respond to the patient alarm signal. In most patient call systems, the person monitoring the system can reset or clear the alarm signal from the central monitoring station 250. In addition, most hospital systems include an audio intercom link with each patient room, giving the nurse or other healthcare provider the ability to assess the appropriate response prior to traveling to the patient's room if the patient is communicative. Many hospitals also monitor vital signals from a central monitoring station which enable the healthcare provider at the monitoring station to summon further assistance in extreme emergencies.

The present invention provides an improved wireless patient call system 10 which includes a patient call unit 40 and a corresponding wall unit 60. Wall unit 60 is retrofit mounted onto or near the preexisting room port 230 in any convenient manner. One manner of retrofit mounting wall unit 60 near preexisting room port 230 is described below in detail. In the embodiment shown in FIG. 1, the retrofit patient call system 10 includes coupling interface 70 which couples the retrofit system 10 with preexisting room port 230 and call switch 210.

In FIG. 1, patient call unit 40 of the present invention includes wristband or strap 42. Wristband 42 can be made of different materials including cloth, plastic, nylon or a polycotton blend. In the preferred embodiment, wristband 42 is made of a flexible polymer substantially similar to those commonly used in hospitals for identification bracelets. Typically, strap 42 cannot be cut or pulled off by the patient. Patient call unit 40 is securely mounted on the patient by fastening wristband 42 around the patient's wrist (see FIG. 2) in much the same way as the aforementioned identification bracelets are fastened. The wristband is removed by cutting the plastic. Patient call unit 40 can be manufactured together with wristband or strap 42 or separate with strap loops (not shown) to permit a strap to be inserted therein. Patient call unit 40 may also be securely fastened or strapped to a patient's waist, the patient's garments or at another convenient location.

Figure 2:
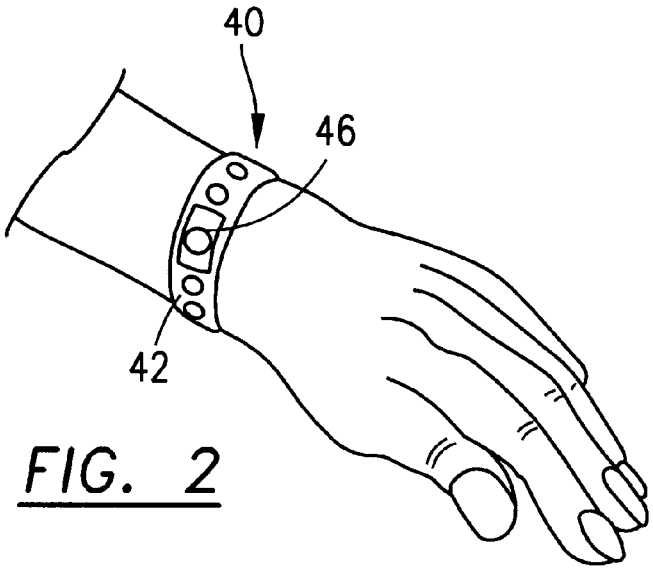
FIG. 2 diagrammatically illustrates a patient call unit attached to a patient's wrist (one method of attaching the call unit to the patient)
Figure 4:
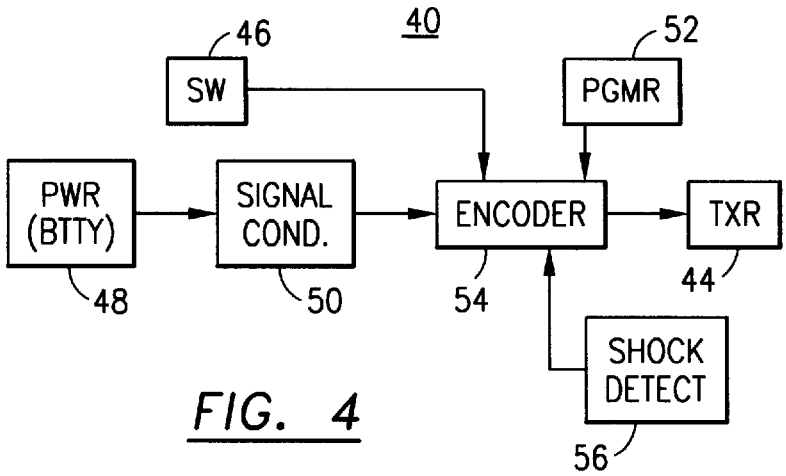
FIG. 4 illustrates a block diagram of the major functional elements of the patient call unit.

Patient call unit 40 includes a user actuated control 46 (shown in FIGS. 1 and 2). The user actuated control 46 can be a push-button switch, a touch pad with a sealed membrane-switch, or other similar, low-profile, light-weight and inexpensive switch mechanism. The user actuated control 46 is electrically coupled to encoder 54 (see FIG. 4). Encoder 54 is electrically coupled to transceiver 44, signal conditioner 50 and programmable interface 52. In one embodiment, transceiver 44 is simply a transmitter 44 and does not include a receiver. Programmable interface 52 is coupled to transceiver 44 and to encoder 54. Battery (or other power source) 48 is coupled to signal conditioner 50.

Patient call unit 40 may also include a fall detector 56, electrically coupled to encoder 54. Fall detector 56 may be a shock detector, an accelerometer or an impact detector.

Wall unit 60 is retrofit mounted at or near preexisting room port 230 (FIG. 1) in any convenient manner (e.g. screws with anchors). Wall unit 60 includes a transceiver 80 (see FIG. 5). Transceiver 80 may simply be a receiver with no transmitting capability. Transceiver 80 is electrically coupled to input/output unit 82. Input/output unit 82 is coupled to display 66, reset switch 64, signal conditioner 88, programmable unit 84 and indicator 62.

Figure 3:
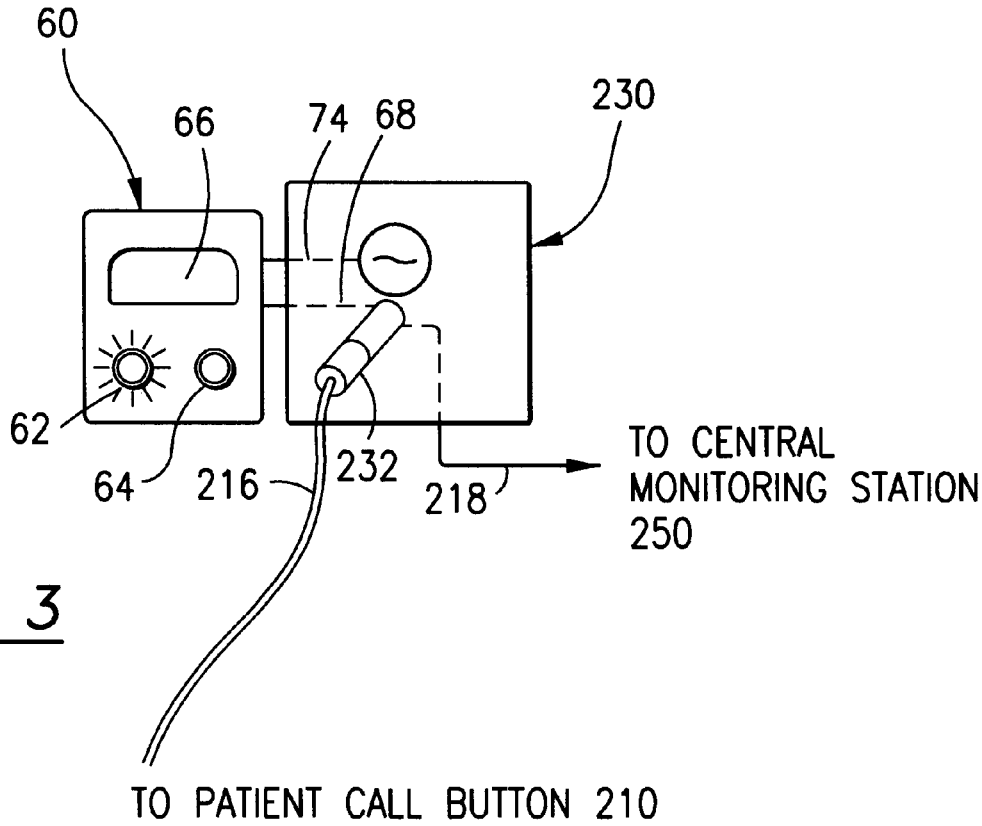
FIG. 3 diagrammatically illustrates a wall unit retrofit mounted next to the preexisting patient call system room port.

Indicator 62 in FIG. 1 is a light-emitting diode (LED). In FIG. 3, indicator 62 is a lamp. Other visual indicators may be utilized. Alternatively, or in conjunction with a visual indicator, indicator 62 may also be an audio indicator.

Signal conditioner 88 is coupled to line 68. Line 68 may be a cluster of conductors or other link providing a means to couple wall unit 60 to preexisting room port 230. Line 68 is coupled to room port 230 via preexisting jack 232 on room port 230. In FIG. 1, line 68 is coupled to room port 232 via coupling interface 70. Coupling interface 70 is coupled to line 68, preexisting flexible conductor 216 and preexisting jack 232 on room port 230. Coupling interface 70 provides either a parallel connection or a series connection between preexisting flexible conductor 216 and preexisting jack 232 on room port 230. In one embodiment coupling interface 70 includes switch 72 permitting the interface to be changed from a parallel configuration to a series configuration depending upon the design of the preexisting patient call system 200. Hence, wall unit 60 is retrofit onto room port 230.

Figure 5:
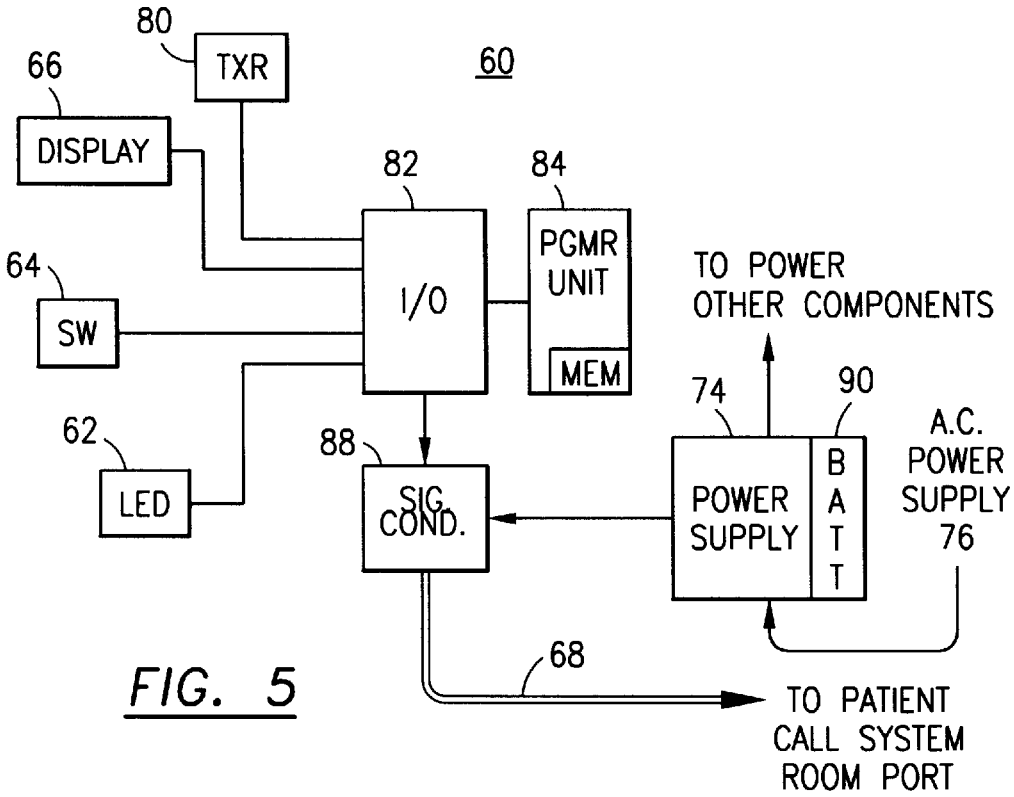
FIG. 5 illustrates a block diagram of the major functional elements of the wall unit.

Wall unit 60 requires a power supply 74. Power supply 74 in FIG. 1 includes a transformer 78 plugged into a nearby wall outlet 76. Power supply 74 can also be coupled to wall unit 60 internally through a knock-out located on the back of wall unit 60 (not shown) so as to avoid having externally disposed wires or components of the power supply (see FIG. 3). Likewise, the coupling between line 68 and room port 230 may also be accomplished without externally disposed components. In FIG. 5, power supply 74 is coupled to signal conditioner 88. Power supply 74 may also be coupled to a battery back-up 90.

FIG. 3 diagrammatically illustrates an alternative retrofit mounting of wall unit 60. Wall unit 60 is mounted near preexisting room port 230. In FIG. 3, wall unit 60 is coupled to room port 230 internally through line 68 (shown as dashed line). Likewise, power supply 74 of wall unit 60 is coupled to room port 230 internally (shown as dashed line).

Operation of the Invention

The retrofit patient call system 10 operates as follows. A healthcare provider securely mounts a patient call unit 40 onto the patient by fastening wristband 42 around the patient's wrist. The wristband 42 is permanently attached and can only be removed by cutting the band. Alternatively, patient call unit 40 can be mounted or strapped to the patient at the patient's waist, garments or other suitable location. The patient activates user actuated control 46 (shown in FIG. 1 as a push-button). Through signal conditioner 50, battery 48 provides power to patient call unit 40 and its component parts, encoder 54 and transceiver 44. Upon actuation, user actuated control 46 signals encoder 54. Encoder 54 generates a programmed output signal to transceiver 44. Transceiver 44 generates a coded RF patient call signal 86 (see FIG. 1) which is received by transceiver 80 of wall unit 60 mounted near preexisting room port 230.

Transceiver 80 of wall unit 60 detects coded RF patient call signal 86 and sends a signal to input/output 82. Programmable unit 84, coupled to input/output 82, detects the signal from transceiver 80 and sends outputs to input/output 82. These outputs enable display 66 to display a numerical count of the time elapsed and the time of reception of the patient call signal 86. The outputs also enable the signal conditioner 88 to send a patient alarm signal. The outputs may also enable indicator 62.

Upon receiving the output from programmable unit 84 (through input/output 82), signal conditioner 88 sends a patient alarm signal through conductor 68. Conductor 68 is coupled to preexisting room port 230 either internally (FIG. 3) or via jack 232. The patient alarm signal is sent through room port 230 to central monitoring station 250 in the same manner as a patient alarm signal generated by the preexisting patient-activated call switch 210.

Patient call unit 40 may also include a fall detector 56 which enables or turns ON transceiver 44 upon the patient call unit being abruptly jarred or undergoing a sharp deceleration. Once enabled, transceiver 44 sends an RF patient call signal to wall unit 60 in substantially the same manner as if the patient had enabled user actuated control 46. The patient call system then works as previously described above.

Programmable unit 84 in wall unit 60 may be programmed to enable indicator 62 to audibly or visually indicate reception of patient call signal 86. In addition, programmable unit 84 may also be programmed to have indicator 62 flash during programming of either patient call unit 40 or wall unit 60.

Reset switch 64 is used to reset programmable unit 84. In one embodiment, reset switch 64 has enabled and disabled states. During normal operation, the reset switch 64 is in the disabled state. Upon actuation or enabling of reset switch 64, indicator 62 is cleared or reset, display 66 may be cleared, and programmable unit 84 is reset in order to stop the generation of further patient alarm signals.

Display 66 may be utilized to display a wide range of information. Such information may include indication that patient call unit 40 has been powered up, indication that wall unit 60 has received a patient call signal, the time elapsed since reception of a patient call signal, information regarding programming, status of back-up battery 90, or a combination thereof.

Programming Retrofit Patient Call System

Prior to fastening patient call unit 40 to a patient, it is necessary that the retrofit patient call system 10 be programmed such that a particular patient call unit 40 is able to communicate with a unique, corresponding wall unit 60. In a setting with multiple patient call units and multiple corresponding wall units, each retrofit patient call system must be programmed to communicate through a unique or specifically encoded RF signal specific to a particular wall unit. The purpose of programming each retrofit system is to avoid having one patient call unit enable multiple wall units, thus causing false patient alarm signals to be sent to the central monitoring station. Programming the system can be accomplished by one or a combination of methods.

One method of programming a respective patient call unit 40 to communicate with a corresponding wall unit 60 is through utilization of a program command sequence. A healthcare facility staff member places a patient call unit 40 near a corresponding wall unit 60. Next, reset switch 64 is held down continuously for approximately 5 seconds, and then released. This signals programmable unit 84 of wall unit 60 that a patient call unit is about to transmit its coded RF signal for programming. Next, user actuated control 46 of patient call unit 40 is held down for approximately 3 to 5 seconds or until either indicator 62 gives an audible or visual indication that programming is complete, or a message is displayed on display 66. During the 3 to 5 seconds of programming, wall unit 60 is synchronizing its transceiver 80 to receive the RF signal produced and transmitted by transceiver 44 of patient call unit 40. Once synchronization is complete, programming is complete. Next, patient call unit 40 is tested by enabling user actuated control 46. The system is then reset by pressing reset 64. In an alternative embodiment, patient call unit 40 synchronizes its transceiver 44 to communicate with the RF signal produced by transceiver 80 of wall unit 60 during programming. The table below is another program command sequence which can be used to establish communication between patient call unit 40 and wall unit 60.

Exemplary Program Command Sequence Table

1. Depress user actuated control switch 46 on patient call unit 40 for 5 seconds continuously.
2. Depress control switch 46 three times in 5 seconds, and then four times in the next 5 seconds.
3. Listen or look for feedback from indicator 62 or display 66 on wall unit 60 mounted near room port 230.
4. Depress control switch 46 on call unit 40 and within 5 seconds depress reset button 64 on wall unit 60.

Any other control command sequence with responsive audio/visual indicators from wall unit 60 can be used. The above-listed table is an example of a possible combination.

In an alternative embodiment, the retrofit patient call system can be programmed through programmable interface 52 on patient call unit 40. Programmable interface 52 may be a series of dip-switches which would allow a healthcare facility staff member to program patient call unit 40 to transmit a unique or an encoded RF signal specific to a particular patient room wall unit 60. Alternatively, programmable interface 52 may be a port to which a healthcare facility member could couple patient call unit 40 to a master programming unit. The coupling between the patient call unit and master programming unit could be a cable, an infrared link, or any conventional means to communicatively link the two. The healthcare facility member could then program the patient call unit 40 to transmit at a unique RF signal particular to the patient room assigned to the patient.

In another embodiment, each patient call unit 40 is pre-programmed to transmit a predetermined coded RF signal. The healthcare facility staff member then programs a particular wall unit to receive the predetermined RF signal of the pre-programmed patient call unit. This programming may be accomplished through a series of steps similar to the programming command sequence discussed above.

In yet another embodiment, patient call unit 40 can be turned ON and programmed active (to establish a unique RF code and signal channel with wall unit 60) with a removable strip (not shown) which engages power supply 48 with encoder 54 of patient call unit 40. Once activated, patient call unit 40 synchronizes with a corresponding wall unit 60 to establish the RF signal link. The most important aspect of programming the system is establishing communication between a particular patient call unit 40 and a corresponding wall unit 60.

Another method of programming a particular patient call unit 40 to communicate with a specific wall unit 60 is through the use of a programming radio frequency ($RF_p$). An $RF_p$ signal can be utilized to initiate communication between the devices. Once communication is established (e.g. through use of a command sequence), patient call unit 40 and corresponding wall unit 60 exchange information regarding a predetermined operating radio frequency ($RF_o$) unique to that particular pair.

Figure 6:
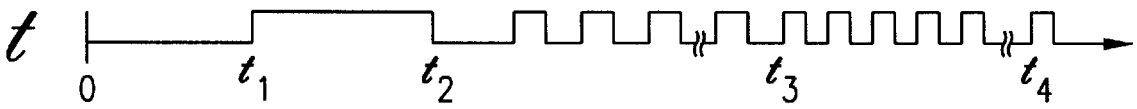
FIG. 6 illustrates an exemplary timing diagram for triggering multiple patient alarm signals from a singular RF patient call signal.

Wall unit 60 can also be programmed to send a patient alarm signal to room port 230 in the same form as preexisting patient call switch 210. For example, if the preexisting system utilizes a high edge to signal the central monitoring station 250 of a patient alarm, programmable unit 84 can be programmed to cause a high edge (see FIG. 6, $t_0$–$t_2$). Alternatively, or in addition to such a high edge, programmable unit 84 can be programmed to become a multiple patient alarm signal generator, generating a series of patient alarm signals after a time $t_2$ (FIG. 6). If after a time $t_3$, the patient's call has not been responded to, another sequence of more rapidly occurring patient alarm signals are sent to central monitoring station 250.

Wall unit 60 can also be configured to accept an input through input/output 82 from central monitoring station 250 in order to reset the system. In some preexisting patient call systems 200, the healthcare provider monitoring the system is able to reset a patient alarm signal from a central location by sending a signal to the patient room through channel 218. Wall unit 60 can be programmed to reset a patient alarm signal by monitoring incoming signals coming from central monitoring station 250 through channel 218, room port 230 and conductor 68.

The claims appended hereto are meant to cover modifications and changes within the spirit and scope of the present invention.

What is claimed is:

1. A patient call system adapted to retrofit onto a preexisting patient call system, said preexisting patient call system having at least one patient-activated call switch disposed near a patient and electrically coupled to a room port located in a patient room, each said room port electronically coupled to a central monitoring station and sending a patient alarm signal to said central monitoring station, the retrofit patient call system comprising:

a patient call unit adapted to be securely mounted on said patient, said patient call unit having a user actuated control coupled to a transmitter, said transmitter generating a patient call signal upon actuation of said user control; and a wall unit adapted to be mounted in a retrofit manner near said room port, said wall unit having a receiver in communication with said transmitter in said patient call unit, and said wall unit adapted to be coupled to said room port such that said receiver generates said patient alarm signal upon receipt of said patient call signal from said patient call unit.

2. A retrofit patient call system as claimed in claim 1 wherein said patient call unit includes a wristband, said band adapted to encircle a patient wrist.

3. A retrofit patient call system as claimed in claim 1 wherein said patient call unit includes a strap, said strap adapted to position said patient call unit on one of a patient wrist and a patient waist.

4. A retrofit patient call system as claimed in claim 3 further comprising a coupling interface, said coupling interface adapted to be placed intermediate said preexisting call switch and preexisting room port, said coupling interface electrically connecting said wall unit and receiver and adapted to be electrically connected to said preexisting patient call system.

5. A retrofit patient call system as claimed in claim 4 wherein said patient call unit includes a fall detector, said fall detector being one of a shock detector, an accelerometer and an impact detector, said fall detector coupled to said transmitter, said transmitter generating a patient call signal upon actuation of said fall detector.

6. A retrofit patient call system as claimed in claim 5 wherein said transmitter in said patient call unit transmits a radio frequency signal to said receiver in said wall unit.

7. A retrofit patient call system as claimed in claim 4 wherein said patient call unit includes a programmable unit;

said user actuated control is coupled to said transmitter and said programmable unit; and said programmable unit generating a pre-programmed patient call signal via said transmitter unique to said patient call unit.

8. A retrofit patient call system as claimed in claim 7 wherein said wall unit includes an indicator, a reset input and a programmable unit coupled together;

said indicator indicating receipt of said patient call signal by said receiver;

said reset input coupled to said receiver and stopping the generation of said patient alarm signal;

said programmable unit programmed to accept only a unique patient call signal from said patient call unit.

9. A retrofit patient call system as claimed in claim 8 wherein said programmable unit includes a programmer which, upon receipt of said patient call signal generated by a unique patient call unit, programs said programmable unit only to respond to said unique patient call unit.

10. A retrofit patient call system as claimed in claim 9 wherein said indicator includes a timer and a time display to indicate elapsed time from receipt of said patient call signal.

11. A retrofit patient call system as claimed in claim 10 wherein said wall unit includes a multiple patient alarm signal generator coupled to said receiver, said multiple patient alarm signal generator generating, sequentially, multiple patient alarm signals to said preexisting patient call system at predetermined time intervals after receipt of said patient call signal from said patient call unit.

12. A retrofit patient call system as claimed in claim 1 further comprising a coupling interface, said coupling interface adapted to be placed intermediate said preexisting call switch and preexisting room port, said coupling interface electrically connecting said wall unit and receiver and adapted to be electrically connected to said preexisting patient call system.

13. A retrofit patient call system as claimed in claim 1 wherein said patient call unit includes a fall detector, said fall detector being one of a shock detector, an accelerometer and an impact detector, said fall detector coupled to said transmitter, said transmitter generating a patient call signal upon actuation of said fall detector.

14. A retrofit patient call system as claimed in claim 1 wherein said transmitter in said patient call unit transmits a radio frequency signal to said receiver in said wall unit.

15. A retrofit patient call system as claimed in claim 1 wherein said patient call unit includes a programmable unit;

said user actuated control is coupled to said transmitter and said programmable unit; and said programmable unit generating a pre-programmed patient call signal via said transmitter unique to said patient call unit.

16. A retrofit patient call system as claimed in claim 1 wherein said wall unit includes an indicator, a reset input and a programmable unit coupled together;

said indicator indicating receipt of said patient call signal by said receiver;

said reset input coupled to said receiver and stopping the generation of said patient alarm signal;

said programmable unit programmed to accept only a unique patient call signal from said patient call unit.

17. A retrofit patient call system as claimed in claim 16 wherein said programmable unit includes a programmer which, upon receipt of said patient call signal generated by a unique patient call unit, programs said programmable unit only to respond to said unique patient call unit.

18. A retrofit patient call system as claimed in claim 16 wherein said indicator includes a timer and a time display to indicate elapsed time from receipt of said patient call signal.

19. A retrofit patient call system as claimed in claim 1 wherein said wall unit includes a multiple patient alarm signal generator coupled to said receiver, said multiple patient alarm signal generator generating, sequentially, multiple patient alarm signals to said preexisting patient call system at predetermined time intervals after receipt of said patient call signal from said patient call unit.

20. A method of retrofitting a preexisting patient call system having at least one patient-activated call switch disposed near a patient and electrically coupled to a room port located in a patient room, each said room port electronically coupled to a central monitoring station and sending a patient alarm signal to said central monitoring station, the method of retrofitting comprising the steps of:

providing a patient call unit and a remotely disposed wall unit;

securely mounting said patient call unit on said patient;

electrically coupling said wall unit to said preexisting patient call system by retrofit mounting said wall unit next to said room port;

transmitting a radio frequency (RF) patient call signal from said patient call unit to said wall unit upon actuation of said patient call unit by said patient; and converting at said wall unit said RF patient call signal into said patient alarm signal via said wall unit and said room port.

21. A method as claimed in claim 20 wherein said securely mounting step includes the step of strapping said patient call unit to said patient.

22. A method as claimed in claim 21 further comprising the step of programming said patient call unit to encode said RF patient call signal and enable a unique communications link between said patient call unit and said wall unit.

23. A method as claimed in claim 22 further comprising the step of transmitting an RF patient call signal from said patient call unit to said wall unit when said patient call unit is abruptly jarred.

24. A method as claimed in claim 23 further comprising the step of visually or audibly indicating the presence of said patient call signal.

25. A method as claimed in claim 24 further comprising the step of displaying time elapsed from said actuation of said patient call unit by said patient.

26. A method as claimed in claim 25 wherein said coupling step includes the step of conditioning said patient alarm signal to match said preexisting patient call system.

27. A method as claimed in claim 26 further comprising the step of resetting said wall unit and withdrawing said patient alarm signal after generating said patient alarm signal.

28. A method as claimed in claim 27 further comprising the step of sending multiple patient alarm signals at predetermined intervals of time subsequent to said actuation of said patient call unit by said patient.

29. A method as claimed in claim 20 further comprising the step of programming said patient call unit to encode said RF patient call signal and enable a unique communications link between said patient call unit and said wall unit.

30. A method as claimed in claim 20 further comprising the step of transmitting an RF patient call signal from said patient call unit to said wall unit when said patient call unit is abruptly jarred.

31. A method as claimed in claim 20 further comprising the step of visually or audibly indicating the presence of said patient call signal.

32. A method as claimed in claim 20 further comprising the step of displaying time elapsed from said actuation of said patient call unit by said patient.

33. A method as claimed in claim 20 wherein said coupling step includes the step of conditioning said patient alarm signal to match said preexisting patient call system.

34. A method as claimed in claim 20 further comprising the step of resetting said wall unit and withdrawing said patient alarm signal after generating said patient alarm signal.

35. A method as claimed in claim 20 further comprising the step of sending multiple patient alarm signals at predetermined intervals of time subsequent to said actuation of said patient call unit by said patient.

36. A retrofit patient call system adapted to be installed as a retrofit in combination with a preexisting patient call system, said preexisting patient call system having at least one patient-activated call switch disposed near a patient and electrically coupled to a room port located in a patient room, each said room port electronically coupled to a central monitoring station and sending a patient alarm signal to said central monitoring station, the retrofit patient call system comprising:

a patient call unit adapted to be securely mounted on said patient, said patient call unit having a user actuated control coupled to a transmitter, said transmitter generating a patient call signal upon actuation of said user control; and a wall unit adapted to be mounted in a retrofit manner near said room port, said wall unit having a receiver in communication with said transmitter in said patient call unit, and said wall unit adapted to be coupled to said room port such that said receiver generates said patient alarm signal upon receipt of said patient call signal from said patient call unit.

37. A retrofit patient call system as claimed in claim 36 wherein said patient call unit includes one of a wristband and a strap.

38. A retrofit patient call system as claimed in claim 37 further comprising a coupling interface, said coupling interface adapted to be placed intermediate said preexisting call switch and preexisting room port, said coupling interface electrically connecting said wall unit and receiver and adapted to be electrically connected to said preexisting patient call system.

39. A retrofit patient call system as claimed in claim 38 wherein said patient call unit includes a fall detector, said fall detector being one of a shock detector, an accelerometer and an impact detector, said fall detector coupled to said transmitter, said transmitter generating a patient call signal upon actuation of said fall detector.

40. A retrofit patient call system as claimed in claim 39 wherein said patient call unit includes a programmable unit;

said user actuated control is coupled to said transmitter and said programmable unit; and said programmable unit generating a pre-programmed patient call signal via said transmitter unique to said patient call unit.

41. A retrofit patient call system as claimed in claim 40 wherein said wall unit includes an indicator, a reset input and a programmable unit coupled together;

said indicator indicating receipt of said patient call signal by said receiver;

said reset input coupled to said receiver and stopping the generation of said patient alarm signal;

said programmable unit programmed to accept only a unique patient call signal from said patient call unit.

42. A retrofit patient call system as claimed in claim 41 wherein said programmable unit includes a programmer which, upon receipt of said patient call signal generated by a unique patient call unit, programs said programmable unit only to respond to said unique patient call unit.

43. A retrofit patient call system as claimed in claim 42 wherein said indicator includes a timer and a time display to indicate elapsed time from receipt of said patient call signal.

44. A retrofit patient call system as claimed in claim 43 wherein said wall unit includes a multiple patient alarm signal generator coupled to said receiver, said multiple patient alarm signal generator generating, sequentially, multiple patient alarm signals to said preexisting patient call system at predetermined time intervals after receipt of said patient call signal from said patient call unit.

* * * * *